United States Patent [19]

Loy et al.

[11] Patent Number: 4,655,634

[45] Date of Patent: Apr. 7, 1987

[54] ROAD PLANER CONTROL AND SAFETY SYSTEM

[75] Inventors: Robert E. Loy, Bucyrus, Ohio; Donald C. Baldwin, Libertyville, Ill.

[73] Assignee: Dresser Industries, Inc., Dallas, Tex.

[21] Appl. No.: 778,867

[22] Filed: Sep. 23, 1985

[51] Int. Cl.[4] ..... E01C 23/12

[52] U.S. Cl. ..... 404/84; 404/90; 180/286; 361/192

[58] Field of Search ..... 404/90, 122, 84; 180/286; 307/38, 39, 125; 361/192, 343

[56] References Cited

U.S. PATENT DOCUMENTS

| | | | |
|---|---|---|---|
| 2,876,856 | 3/1959 | Greene | 180/286 |
| 3,686,510 | 8/1972 | Korb | 361/192 |
| 4,074,787 | 2/1978 | Cunningham et al. | 180/286 |
| 4,139,318 | 2/1979 | Jakob et al. | 404/90 |
| 4,212,574 | 7/1980 | Dreier | 180/286 |

FOREIGN PATENT DOCUMENTS

| | | | |
|---|---|---|---|
| 2300173 | 10/1976 | France | 404/90 |

*Primary Examiner*—James A. Leppink
*Assistant Examiner*—Terry Lee Melius
*Attorney, Agent, or Firm*—Sigalos & Levine

[57] ABSTRACT

A road planer machine having a housing containing a rotating planer drum and having access doors in the housing for maintenance and inspection of the cutting equipment which includes detectors for determining when the access doors are not in their normally closed positions and for disabling the propulsion system of the planer machine as well as the drum rotating system so that the machine can neither move nor the drum rotate if any of the access closure doors are not in their normally closed position.

13 Claims, 4 Drawing Figures

ROAD PLANER CONTROL AND SAFETY SYSTEM

BACKGROUND OF THE PRESENT INVENTION

The present invention relates to a safety device for a road planer machine and in particular to apparatus for preventing a planer drum from rotating or the road planer from moving if an access closure door on the housing enclosing the planer drum is not in its normally closed position.

Road planers are large machines having a housing suspended from the frame which carries a rotating planer drum. The housing is enclosed on all sides except for the bottom through which the rotating planer drum protrudes to tear up concrete pavement and prepare it for resurfacing. The rotating planer drum has fingers protruding therefrom which cause the concrete surface to be removed. At least one access closure means such as a door is formed in the housing so that the drum can be serviced and maintained. It is evident that if the drum is rotating when the access closure means is opened a highly dangerous situation exists. If the rotating drum should come in contact with the road surface it may well impel road particles such as concrete pieces or bits at high speeds out of the open access thereby causing injury to persons in the vicinity thereof. In addition, if maintenance personnel happen to be working in front of the open access door and the planer machine for some reason began to move forward, severe injuries could occur to the individuals in front of the open doors.

Therefore, it is important that power be removed from the rotating drum to prevent rotation thereof in the event the access means or doors are opened. It is also important that the machine be disabled from moving forward if the access doors are opened.

Thus, it is an object of the present invention to provide a road planer in which power is automatically removed from the rotating drum to prevent rotation thereof in the event the access closure is not in its normally closed position.

It is also an object of the present invention to remove power from the propulsion means of the road planer in the event that the access closure on the rotating drum housing is not in its normally closed position.

It is still another object of the present invention to set the brakes of the road planer machine so that the machine cannot move forward in the event that the access closure on the housing enclosing the rotating drum is not in its normally closed position.

It is yet another object of the present invention to provide a signal representing the access closure panel not in its normally closed position and utilizing that signal to disable the propulsion system for the road planer, the drum rotation and positioning control system, and other associated active systems such as conveyor belts and to activate the brakes of the road machine.

SUMMARY OF THE PRESENT INVENTION

Thus, the present invention relates to a road planer having an engine, a propulsion motor, a parking brake, a rotatable planer drum and drum positioning devices comprising a hydraulic system coupled to said engine for generating hydraulic power, first, second and third hydraulic actuators coupled to said hydraulic system and to said propulsion motor, said parking brake and said planer drum respectively for selectively and separately driving said propulsion motor, actuating said parking brake and rotating and positioning said planer drum, an enclosed housing open at the bottom thereof for carrying said rotatable planer drum, at least one access closure means in said housing for enabling inspection and service of said drum, detection means coupled to and actuated by said at least one access closure means to provide a signal when said access means is not in its normally closed position in said housing and means coupled to said detection means for utilizing said signal to disable said first, second and third hydraulic actuators when said access closure means is not in its normally closed position in said housing thereby preventing either movement of said road planer or rotation of said drum.

BRIEF DESCRIPTION OF THE DRAWINGS

These and other objects of the present invention will be more fully disclosed in conjunction with the accompanying drawings in which like numerals represent like components and in which.

DETAILED DESCRIPTION OF THE DRAWINGS

Figure 1:
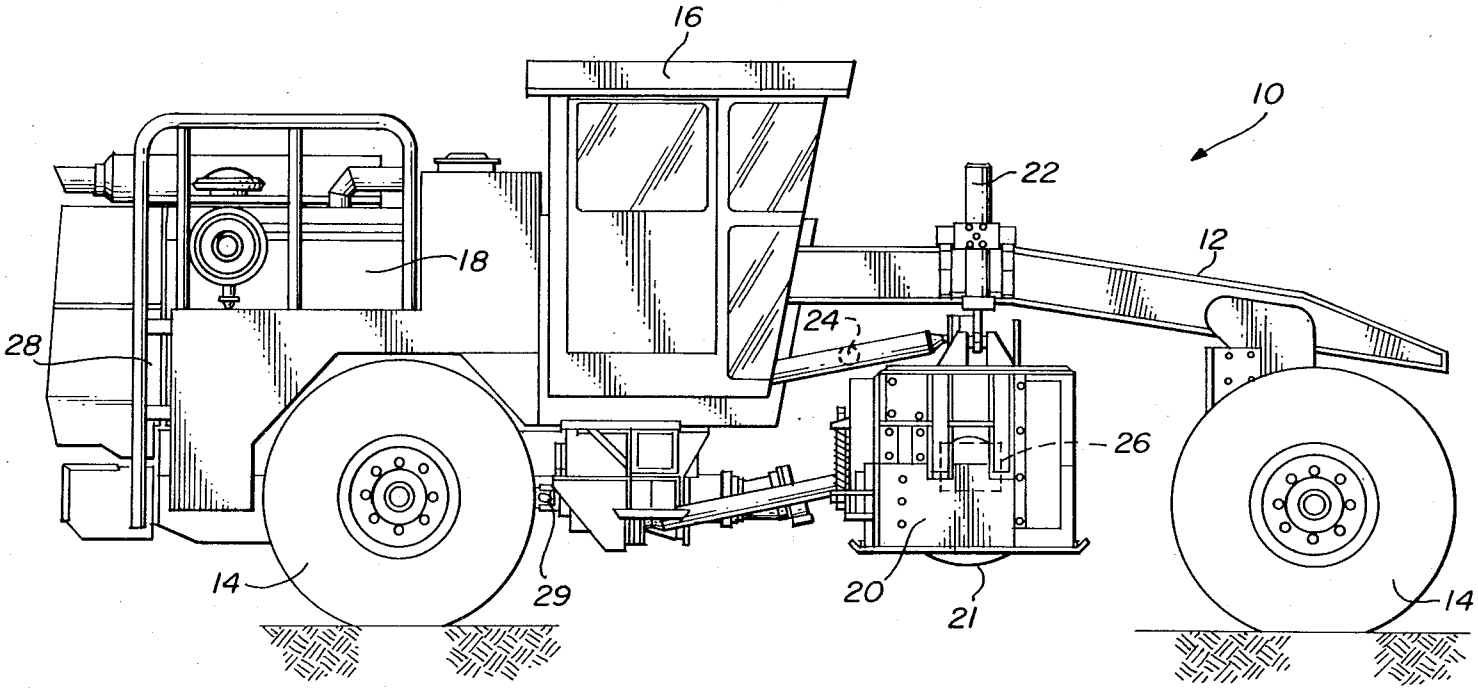
FIG. 1 is a side view of a typical road planer illustrating the manner in which the rotating drum and housing is suspended from the frame thereof.

FIG. 1 is a side view of a typical road planer machine 10 which has a frame 12 riding on a rotatable means such as tires 14 and having thereon an operator's cab 16. The unit has an engine 18 for a power source and has a planer drum encased within a housing 20 for rotation therein. The housing is closed on the top, the ends and the sides but is open on the bottom so that the rotating planer drum which has rigid fingers thereon may be utilized to tear up a concrete surface and prepare it for resurfacing. Hydraulic actuators such as 22 may lower and raise the housing 20 while actuator 24 can move the housing 20 in a pivoting motion while drive unit 26 causes the drum to rotate within housing 20. A hydraulic unit 28 may be driven by engine 18 to provide the hydraulic power necessary to provide power to actuators 22, 24 and 26 as well as to coupling 29 to provide drive power to the wheels 14.

Figure 2:
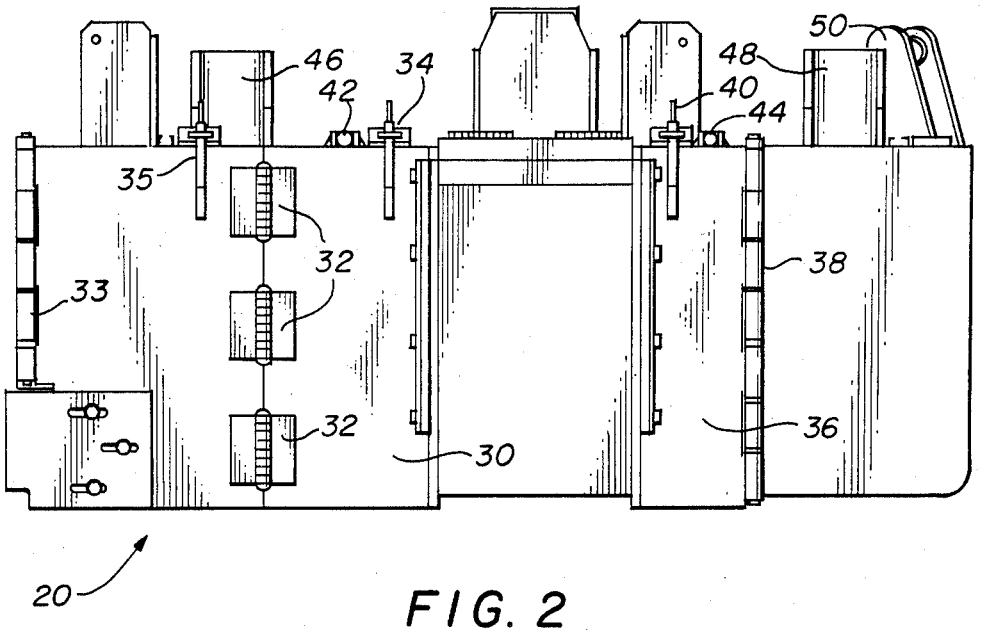
FIG. 2 is a front view of the rotating drum housing illustrating the access doors for service and inspection of the drum therein.

FIG. 2 is a front view of the drum housing 20 which encloses the rotating drum 21. Housing 20 includes a first access closure means or door 30 foldable about hinges 32 and further foldable about hinge 33 to provide access to at least part of the drum 21 for service and inspection. Latches 34 and 35 hold the door in its closed position. If desired, latch 34 can be released and door 30 pivoted about hinges 32 to provide a partial view of the drum 21. If a greater area of the drum needs to be inspected, latch 35 can be unfastened and the door 30 further pivoted about hinge 33 to expose a greater portion of drum 21.

In like manner, door 36 is provided with hinge 38 and latch 40 to keep the door 36 in its normally closed position. When it is desired to inspect the right-hand portion of drum 21, latch 40 is unfastened and door 36 pivoted about hinge 38 to provide the necessary access for service and inspection. In addition, brackets 46, 48 and 50 provide the necessary couplings to the hydraulic units for raising, lowering or pivoting the housing 20 with respect to the frame 12.

It will be noted that a detector 42 and detector 44 are provided for doors 30 and 36 respectively. These detectors generate a signal when doors 30 and 36 are not in their normally closed positions. These switches 42 and 44 may be a mechanically operated switch such as a microswitch which may be held in an open position when the access closure means or doors 30 and 36 are in their normally closed position but are allowed to make electrical contact when the doors 30 and 36 are not in their normally closed position. The closing of these contacts generates a signal which will be used to stop any motion of the planer 10 or any rotation of drum 21 as will be more fully explained later herein. Switches 42 and 44 could be of other known types such as magnetic switches which would generate a signal if the doors 30 and 36 are not in their normally closed positions.

Figure 3:
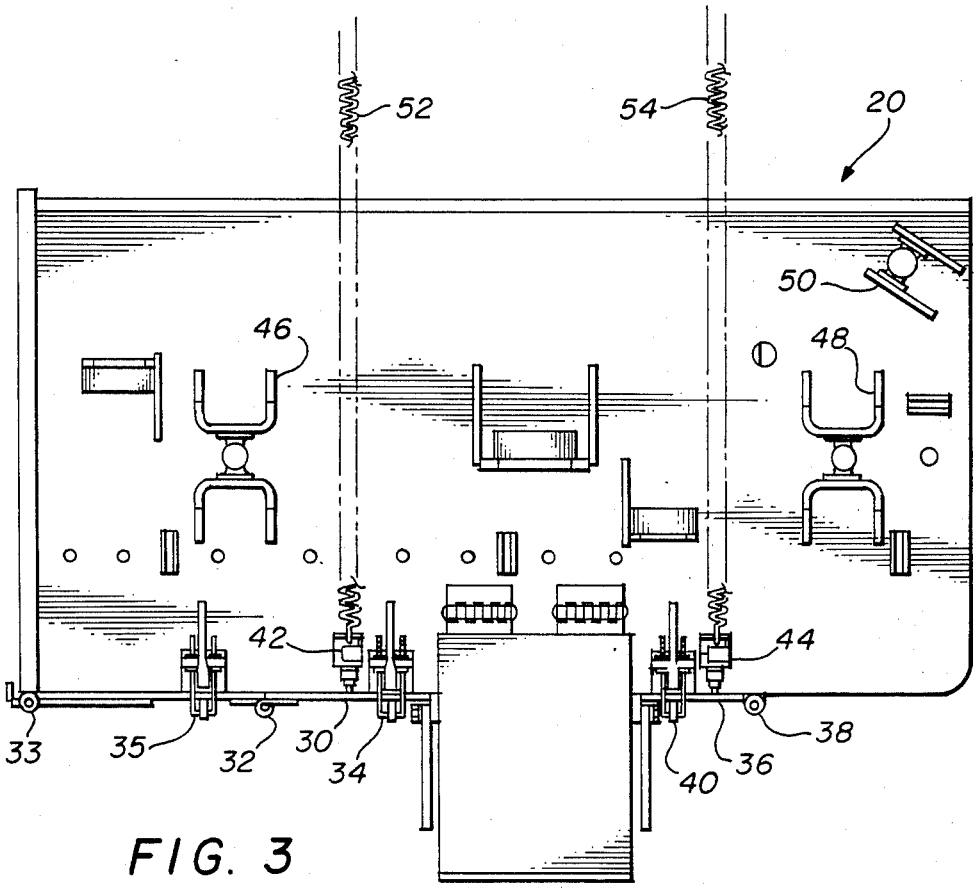
FIG. 3 is a top view of the housing for the rotating planer drum illustrating the detection devices which are mounted thereon to detect when the access closure means is not in its normally closed position.

FIG. 3 is a top view of the housing 20 for the planer rotating drum 21. Again, as will be seen in FIG. 3, doors 30 and 36 are provided for access to service and maintain the rotating drum 21 located within housing 20. Door 30 is hinged about hinges 32 and 33 with the first portion of the door 30 hinged at hinge 32 being held in a closed position by latch 34. If latch 34 is released, it can pivot about hinge 32 to provide inspection and service of the interior of the housing 20. If latch 35 is also released, the entire door 30 may pivot about hinge 33 to provide a greater access to the interior of housing 20. Again, as can be seen in FIG. 3, switch 42 is contacted by and actuated by door 30 to force its contacts in a normally open position when door 30 is in its normally closed position. If latch 34 is released, and door 30 pivots about hinge 32, switch 42 closes its contacts and generates a signal on cable 52 which will be used to stop operation of planer 10 as well as to stop rotation of drum 21 as will be disclosed in more detail hereafter.

In like manner, door 36 is held in its normally closed position by latch 40. If latch 40 should be released, and door 36 tends to pivot away from housing 20 on hinge 38, switch 44 will be actuated and will generate a signal on line 54 which will be used to stop any forward motion of the planer 10 or rotation of planer drum 21.

Figure 4:
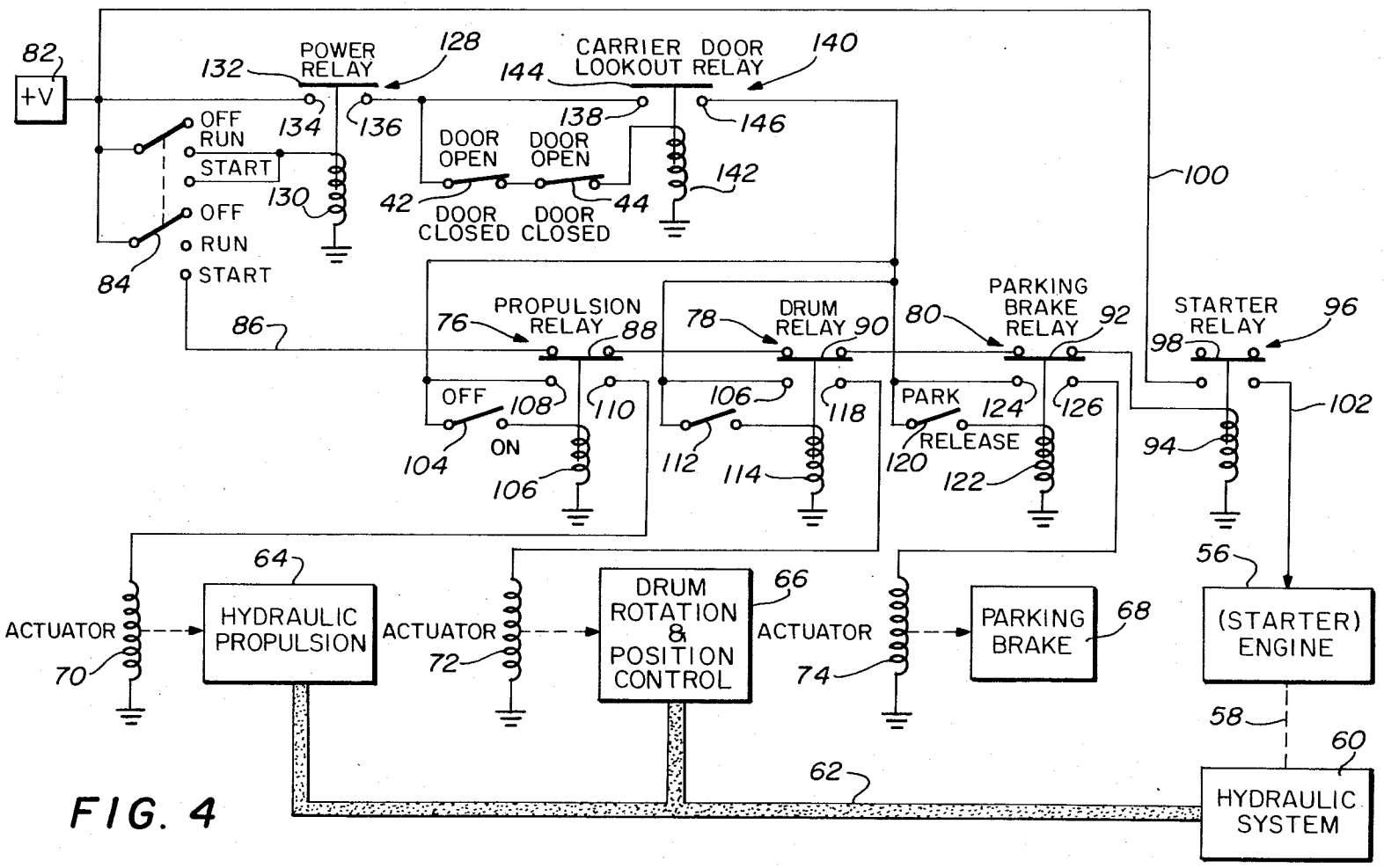
FIG. 4 is a diagrammatic representation of the circuit and apparatus for detecting when an access closure means is not in its normally closed position and thereby generating a signal which disables the planer machine and prevents it from moving and also prevents the planer drum from rotating.

FIG. 4 is a diagrammatic representation of the present invention illustrating the manner in which the switches 42 and 44 which detect when doors 30 and 36 are not in their normally closed positions produce the necessary signals to stop operation of the planer 12 insofar as motion is concerned as well as stopping rotation of drum 21. As can be seen in FIG. 4, the road planer has an engine 56, including of course a starter, which utilizes a mechanical drive 58 to power a hydraulic system 60 to produce hydraulic fluid under pressure in conduit 62 and which hydraulic fluid is used to drive the hydraulic propulsion unit 64 and the drum rotation and position control 66. Thus, when engine 56 is operating and the hydraulic system 60 is producing the hydraulic fluid under pressure in conduit 62, if electrical solenoid 70 is actuated, it enables the hydraulic fluid to drive propulsion unit 64 thus causing the road planer 10 to move either forward or in the reverse direction as desired by the operator. In like manner, if actuator 72 is electrically energized, it controls the proper hydraulic valves to allow drum rotation unit 66 to cause the drum to be rotated by the hydraulic pressure as well as allowing the hydraulic controls to be utilized by the operator to position the drum 21 in its proper position. Finally, actuator 74 may be energized by the operator to release the parking brake 68 if it has been set with the use of the available pneumatic pressure thus preventing or allowing the machine to move depending upon whether the parking brake is set or released.

Three major relays 76, 78 and 80 control the operation of the hydraulic propulsion system 64, the drum rotation unit 66 and the parking brake 68. When all of these relays 76, 78 and 80 are de-energized, or the hydraulic propulsion system is deactivated, the drum is not rotating, and the parking brake is set. If double pole triple throw switch 84 is placed in the start position, electrical energy from source 82 will be coupled through switch 84 to line 86 through the closed contacts 88 of relay 76, closed contacts 90 of relay 78 and closed contacts 92 of relay 80 to solenoid coils 94 which energizes the coil 94 of starter relay 96 and causes contactor 98 to move downward thus coupling line 100 to line 102 to the starter of engine 56. Since power from voltage source 82 is present on line 100, this voltage or power is coupled to the starter of engine 56 and enables the engine 56 to be energized. As soon as master switch 84 is placed in the run position, voltage is removed from line 86 and relay coil 94 is de-energized allowing the starter relay 96 to return its contactor 98 to the position shown in FIG. 4 thus removing the voltage from the starter of engine 56.

It will be noted in this circuit that should any of the relays 76, 78 and 80 be energized, it would be impossible to couple the voltage on line 86 to the coil 94 of starter relay 96 thus preventing the engine from being started. This is a safety measure which will prohibit starting of engine 56 should either of the relays 76, 78 or 80 be inadvertently left in the energized position.

During normal operation of the road planer 10, if the operator desires to move the machine, he actuates switch 104 to the on position which energizes relay coil 106 and pulls the contacts 88 of relay 76 to contacts 108 and 110 thus coupling power to actuator 70 which now allows the hydraulic propulsion system 64 to be controlled by the operator and the machine propelled.

In like manner, when the operator closes switch 112, it energizes coil 114 of drum relay 78 allowing contacts 90 to be pulled down to contact terminals 106 and 118 thereby coupling power to actuator 72 to allow the drum to be rotated and controlled by the operator.

In a similar manner, if the operator closes switch 120, coil 122 of parking brake relay 80 is energized thus causing contacts 92 to be pulled downwardly and make contact with terminals 124 and 126 thereby coupling power to actuator 74 which allows the parking brake 68 to be released so that the planer 10 can be allowed to move.

Power relay 128 is closed whenever double pull triple throw switch 84 is in either the run or start positions. In those positions, coil 130 of power relay 128 is energized from power source 82 and contacts 132 of power relay 128 are pulled downwardly from the position shown in FIG. 4 to contact terminals 134 and 136 thereby allowing power to be coupled to terminal 138 of lock out relay 140.

Power from relay 128 is also coupled through door switches 42 and 44 and if the doors are in their normally closed positions, the power is coupled to carrier door lock out relay coil 142 which energizes carrier lock out relay 140 and allows contact 144 to contact terminals 138 and 146 to couple power to the remainder of the circuit. It will be understood then that if either of doors 30 or 36 is not in its normally closed position, either switch 42 or switch 44 or both will be open thus de-energizing relay coil 142 and allowing contacts 144 of carrier door lock out relay 140 to move upwardly to the position shown in FIG. 4 thereby removing power to the propulsion relay 76, the drum relay 78 and the parking brake relay 80. Thus, even though propulsion relay switch 104, drum relay switch 112 or parking brake relay switch 120 may be left in the on position, if either of doors 30 or 36 are not in their normally closed positions, the hydraulic propulsion system will be deactivated thus preventing the road planer 10 from moving, the drum rotation and actuating system will be de-energized so that the drum cannot be rotated or moved, and the parking brake will be allowed to be set by the pneumatic system thus providing an additional feature to prevent the machine from moving.

Thus, the personnel in the vicinity of the road planer 10 are protected whenever the doors 30 and 36 are not in their normally closed positions and there cannot be an inadvertent accident which may cause injury or other difficulties should personnel be near the machine should the doors accidently or deliberately be placed in a position other than their normally closed position.

Thus, there has been disclosed a novel safety device for a road planer which has a housing for containing the rotating planer drum which has access closure means such as doors for inspecting or servicing the drum in the housing and which provides a safety circuit for preventing either movement of the road planer or rotation of the planer drum whenever the access closure means or doors are not in their normally closed positions.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined in the appended claims.

We claim:

1. A safety feature system for a road planer having an engine for providing operating power, a propulsion motor operated by said engine, a parking brake, and a rotatable planar drum and drum positioning devices operated by said engine, said road planer safety feature system comprising:

a. a hydraulic system coupled to said engine for generating hydraulic power, b. first, second and third hydraulic actuators coupled between said hydraulic system and said propulsion motor, said parking brake and said planer drum respectively for selectively and separately driving said propulsion motor, actuating said parking brake and rotating and positioning said planer drum, c. an enclosed housing open at the bottom thereof for carrying said rotatable planer drum, d. at least one access closure means in said housing for enabling inspection and service of said drum, e. detection means coupled to and actuated by said at least one access closure means to provide a signal when said access means is not in its normally closed position in said housing, and f. means coupled to said detection means for utilizing said signal to disable said first, second and third hydraulic actuators when said access closure means is not in its normally closed position in said housing such that said engine continues to provide said operating power while movement of said road planer and rotation of said drum is inhibited.

2. The safety feature system for the road planer as in claim 1 further comprising:

a. a second access closure means in said drum housing for enabling further inspection and service of said drum, b. a second detector means coupled to and actuated by said second access closure means to provide a signal when said second access closure means is not in its normally closed position, and c. means for coupling said signals from both said detector means in series with each of said first, second and third hydraulic actuator disabling means such that said engine continues to provide operating power while movement of said planer and rotation of said drum is inhibited when either of access closure means is not in its normally closed position.

3. A safety feature for a road planer having an engine for providing operating power, and a housing enclosed on the top, sides and ends for carrying a rotating planer drum, said housing having at least one access closure means for enabling inspection and service of said drum, said road planer safety feature comprising:

a. a hydraulic system coupled to said engine for causing said planer drum to rotate, b. an electrically controlled hydraulic actuator coupled to said drum hydraulic rotating system for activating and deactivating said drum rotation, c. a drum rotation relay having a set of power contacts and an actuating coil, said set of contacts having an input coupled to a power source and output coupled to said hydraulic actuator, d. a drum rotation control switch coupled to said relay actuating coil for closing said input and output contacts when said switch is closed and opening said contacts when said switch is open, e. detection means coupled to and actuated by said at least one access closure means to provide a signal when said access means is not in its normally closed position in said housing, f. a carrier closure means lockout relay having an actuating coil and a set of power contacts, said lock out relay actuating coil being coupled to said detection means for closing said lock out relay contacts, g. means coupling said closed carrier closure relay power contacts to said drum rotation relay power contacts and drum rotation control switch, h. a power relay having an actuating coil and a set of power contacts, i. a power control switch coupled to said power relay actuating coil for opening and closing said set of power relay contacts, and j. a power source coupled through said closed power relay contacts to said carrier closure lock out relay contacts and said detection means such that power to said drum rotation relay power contacts and said drum rotation control switch is disconnected when said lock out relay is de-energized such that said engine continues to provide said operating power while preventing said drum from rotating when said drum rotation control switch is closed if said access closure means is not in its normally closed position.

4. A safety feature for a road planer as in claim 3 further including:

a. a hydraulic propulsion system for causing said road planer to move, b. an electrically controlled hydraulic actuator coupled to said hydraulic propulsion system for activating and deactivating said propulsion system, c. a propulsion relay having a set of power contacts and an actuating coil, said set of contacts having an input coupled to a power source and an output coupled to said hydraulic actuator, d. a propulsion control switch coupled to said propulsion relay actuating coil for closing said input and output contacts when said propulsion control switch is closed and opening said contacts when said propulsion control switch is open, and e. means coupling said closed carrier closure relay power contacts to said propulsion relay power contacts and said propulsion control switch such that power to said propulsion relay and said propulsion control switch is disconnected when said lock out relay is de-energized thereby deactivating said propulsion system and preventing said road planer from moving while allowing said engine to continue to provide said operating power if said access closure means is not in its normally closed position.

5. A safety feature for a road planer as in claim 4 further including:

a. a parking brake for preventing said road planer from moving when said brake is set, b. an electrically controlled actuator coupled to said parking brake for releasing said parking brake when it is set, c. a parking brake relay having a set of power contacts and an actuating coil, said set of contacts on said parking brake relay having an input coupled to a power source and an output coupled to said parking brake actuator, d. a parking brake control switch coupled to said parking brake relay actuating coil for closing said input and output contacts when said parking brake switch is closed and opening said contacts when said parking brake switch is open, and e. means coupling said closed carrier relay power contacts to said parking brake relay power contacts and said parking brake control switch such that power to said parking brake relay and said parking brake control switch is disconnected when said lock out relay is de-energized thereby preventing release of said parking brake when it is set and preventing said road planer from moving while allowing said engine to continue to provide said operating power if said access closure means is not in its normally closed position.

6. A method of providing a safety feature for a road planer which has an engine for providing operating power, a propulsion motor, a parking brake, a rotatable planer drum and drum positioning devices comprising the steps of:

a. coupling a hydraulic system to said engine for generating hydraulic power, b. coupling first, second and third hydraulic actuators between said hydraulic system and said propulsion motor, said parking brake and said planer drum respectively for selectively and separately driving said propulsion motor, actuating said parking brake and rotating and positioning said planer drum, c. forming an enclosed housing open at the bottom thereof for carrying said rotatable planer drum, d. providing at least one access closure means in said housing for enabling inspection and service of said drum, e. coupling detection means to and actuated by said at least one access closure means to provide a signal when said access means is not in its normally closed position in said housing, and f. utilizing said detection means signal to disable said first, second and third hydraulic actuators when said access closure is not in its normally closed position in said housing so as to prevent either movement of said road planer or rotation of said drum without inhibiting said engine from providing said operating power.

7. The method of claim 6 further comprising the steps of:

a. providing a second access closure means in said drum housing for enabling further inspection and service of said drum, b. coupling a second detection means to and actuated by said second access closure means to provide a signal when said second access closure means is not in its normally closed position, and c. coupling said signals from both said detection means in series with said first, second and third hydraulic actuator disabling means such that said engine continues to supply said operating power while movement of said planer and rotation of said drum are prevented when either of said access closure means is not in its normally closed position.

8. A method of providing a safety feature for a road planer having an engine for providing operating power and which has a housing enclosed on the top, sides and ends for carrying a rotating planer drum, said housing having at least one access closure means for enabling inspection and service of said drum, said method of comprising the steps of:

a. utilizing a hydraulic system to cause said planer drum to rotate, b. coupling an electrically controlled hydraulic actuator to said drum hydraulic rotating system for activating and deactivating said drum rotation, c. providing a drum rotation relay having a set of power contacts and an actuating coil, said set of contacts having an input coupled to a power source and an output coupled to said hydraulic actuator, d. coupling a drum rotation control switch to said relay actuating coil for closing said input and output contacts when said switch is closed and opening said contacts when said switch is open, e. providing a signal when said access means is not in its normally closed position in said housing, f. providing a carrier closure means lock out relay having an actuating coil and a set of power contacts, said lock out relay actuating coil being energized by said access means signal for closing said lock out relay contacts, g. coupling said carrier closure relay power contacts to said drum rotation relay power contacts and said drum rotation control switch, h. providing a power relay having an actuating coil and a set power contacts, i. coupling a power control switch to said power relay actuating coil for opening and closing said set of power relay contacts, j. coupling a power source through said closed power relay contacts to said carrier closure lock out relay contacts, and k. utilizing said access means signal to de-energize said carrier closure lock out relay such that power to said drum rotation relay power contacts and said drum rotation control switch is disconnected when said lock out relay is de-energized thereby allowing said engine to continue to provide operating power and preventing said drum from rotating when said drum rotation control switch is closed if said access closure means is not in its normally closed position.

9. A method as in claim 8 further including the steps of:

a. utilizing a hydraulic propulsion system for causing said road planer to move, b. coupling an electrically controlled hydraulic actuator to said hydraulic propulsion system for activating and deactivating said propulsion system, c. providing a propulsion relay having a set of power contacts and an actuating coil, said set of contacts having an input coupled to a power source and an output coupled to said hydraulic actuator, d. coupling a propulsion control switch to said propulsion relay actuating coil for closing said input and output contacts when said propulsion control switch is closed and opening said contacts when said propulsion control switch is open, and e. coupling said closed carrier closure relay power contacts to said propulsion relay power contacts and said propulsion control switch such that power to said propulsion relay and said propulsion control switch is disconnected when said lock out relay is de-energized thereby allowing said engine to continue to provide operating power while deactivating said propulsion system and preventing said road planer from moving if said access closure means is not in its normally closed position.

10. A method as in claim 9 further including the steps of:

a. utilizing a parking brake for preventing said road planer from moving when said parking brake is set, b. coupling an electrically controlled actuator to said parking brake for releasing said parking brake, c. providing a parking brake relay having a set of power contacts and actuating coil, said set of contacts on said parking brake relay having an input coupled to a power source and an output coupled to said parking brake actuator, d. coupling a parking brake control switch to said parking brake relay actuating coil for closing said input and output contacts when said parking brake switch is closed and opening said contacts when said parking brake switch is open, and e. coupling said closed carrier relay power contacts to said parking brake relay power contacts and said parking brake control switch such that power to said parking brake relay and parking brake control switch is disconnected when said lock out relay is de-energized thereby allowing said engine to continue to provide operating power while preventing release of said parking brake when it is set and preventing said road planer from moving if said access closure means is not in its normally closed position.

11. In a safety system for a road planer having an engine, an activatable propulsion motor, a parking brake which can be releaseably set, a rotatable planer drum and drum positioning controls and a drum access closure means having an open position to enable inspection and servicing of said drum, the improvement comprising:

a. means for preventing starting of said engine when said parking brake is released, said drum rotation and position controls are energized or said propulsion motor is activated, and b. electrical means coupled to said engine starting prevention means and to said drum access closure means for allowing said engine to continue to operate after starting while preventing release of said parking brake, rotation and positioning of said drum or operation of said propulsion motor of said drum when said drum access closure means is in said open position.

12. An improved safety system as in claim 11 wherein said means for preventing starting said engine comprises:

a. a drum rotation and position control relay, a propulsion motor relay and a parking brake relay, each having a first energization position contact and a second de-energization position contact, b. each of said relays having a switch connected thereto for energizing or de-energizing said relays, c. a starter relay coil and a set of contacts coupled to said engine starter, and d. means for coupling each of de-energization position contacts of drum relay, propulsion motor relay and parking brake relay in series with each other and said starter relay coil such that if any one of said drum relay, propulsion motor relay and parking brake relay is in the energized position, said starter relay is rendered inoperative to prevent starting of said engine.

13. An improved safety system as in claim 12 wherein said means for preventing the release of said parking brake, rotation and positioning of said drum and operation of said propulsion motor comprises:

a. a lock out relay having a coil and contacts for receiving power from the power supply, b. switch means for detecting an open one of said access closure means, c. means for coupling said switch means to said lock out relay coil and said power supply such that said lock out relay is de-energized when said drum access closure means is in said open position, and d. means for coupling said contacts of said lock out relay to said drum rotation and position control relay coil, said parking brake relay coil, and said propulsion motor relay coil such that rotation and positioning of said drum, release of said parking brake and operation of said propulsion motor are prevented when said access closure means is in said open position.

* * * * *